US011745091B2

(12) United States Patent
McLachlan et al.

(10) Patent No.: US 11,745,091 B2
(45) **Date of Patent: *Sep. 5, 2023**

(54) HANDHELD TOUCH APPARATUS WITH MOVABLE TACTILE FEATURES

(71) Applicant: Antsy Labs LLC, Dacono, CO (US)

(72) Inventors: Matthew McLachlan, Dacono, CO (US); Mark McLachlan, Frederick, CO (US)

(73) Assignee: ANTSY LABS LLC, Dacono, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/678,667

(22) Filed: Feb. 23, 2022

(65) Prior Publication Data

US 2022/0176235 A1 Jun. 9, 2022

Related U.S. Application Data

(63) Continuation of application No. 16/332,656, filed as application No. PCT/US2017/049461 on Aug. 30, (Continued)

(51) Int. Cl.
*A63F 9/12* (2006.01)
*A63H 31/00* (2006.01)
(Continued)

(52) U.S. Cl.
CPC ..... *A63F 9/1208* (2013.01); *A63H 31/00* (2013.01); *A63H 33/00* (2013.01); *A63H 33/30* (2013.01); *A63H 33/42* (2013.01)

(58) Field of Classification Search
CPC ..... A63H 31/00; A63H 33/30; A63H 33/42; A63F 9/1208
See application file for complete search history.

(56) References Cited

U.S. PATENT DOCUMENTS

D56,022 S 8/1920 Newton
D188,324 S 7/1960 Brown
(Continued)

FOREIGN PATENT DOCUMENTS

CN 3557150 8/2006
CN 300426034.0000 9/2006
(Continued)

OTHER PUBLICATIONS

Canadian Office Action, CA2997475, dated Jan. 17, 2019.
(Continued)

*Primary Examiner* — Eugene L Kim
*Assistant Examiner* — Alyssa M Hylinski
(74) *Attorney, Agent, or Firm* — Polsinelli PC

(57) ABSTRACT

A handheld touch apparatus for providing a variety of tactile sensations to the fingers and thumb of a hand of a user. The touch apparatus includes a multi-faceted block body having an outer surface defined by a plurality of planar faces joined together by radiused edges that meet together to form rounded corners. The block body is sized for holding within the palm of the user's hand and for being supported, rotated and manipulated by the fingers and thumb of the same hand. The touch apparatus further includes tactile features extending from the planar faces of the block body and that are selectively movable relative to their associated planar faces. The tactile features are contained within the volume of an imaginary sphere defined by the rounded corners and isolated from the tactile features on adjacent planar faces by the radiused edges of the block body.

26 Claims, 11 Drawing Sheets

Related U.S. Application Data

2017, now Pat. No. 11,278,792, which is a continuation-in-part of application No. 29/590,129, filed on Jan. 6, 2017, now Pat. No. Des. 818,054.

(60) Provisional application No. 62/467,721, filed on Mar. 6, 2017, provisional application No. 62/495,418, filed on Sep. 13, 2016.

(51) Int. Cl.

| | |
|---|---|
| ***A63H 33/42*** | (2006.01) |
| ***A63H 33/30*** | (2006.01) |
| ***A63H 33/00*** | (2006.01) |

(56) References Cited

U.S. PATENT DOCUMENTS

| | | | | | |
|---|---|---|---|---|---|
| 2,999,688 | A | | 9/1961 | Gabrielson | |
| 3,566,481 | A | * | 3/1971 | Causer | G09B 25/00 434/260 |
| D261,780 | S | | 11/1981 | Radtke | |
| D262,549 | S | * | 1/1982 | Clanton | D21/475 |
| D278,070 | S | | 3/1985 | Tapdrup | |
| D282,827 | S | | 3/1986 | Hoogner | |
| D296,451 | S | | 6/1988 | Ming | |
| D300,231 | S | | 3/1989 | Herzano | |
| D301,869 | S | | 6/1989 | Schwartz | |
| 4,929,211 | A | * | 5/1990 | Resnick | A63B 23/16 446/14 |
| D323,613 | S | | 2/1992 | Cummins | |
| 5,292,276 | A | * | 3/1994 | Manalo | A63H 5/00 434/258 |
| D351,139 | S | | 10/1994 | Ko | |
| D359,315 | S | | 6/1995 | Tacey | |
| D377,396 | S | | 1/1997 | Maurel | |
| 5,591,062 | A | | 1/1997 | Hettinger | |
| D381,417 | S | | 7/1997 | Simmons | |
| D391,999 | S | * | 3/1998 | Chininis | D21/475 |
| 5,857,892 | A | * | 1/1999 | Leadbetter | A63H 33/00 446/431 |
| D416,871 | S | | 11/1999 | Todd | |
| 5,989,099 | A | * | 11/1999 | Arnold, III | A63H 33/00 446/487 |
| D442,250 | S | | 5/2001 | Leung | |
| D464,682 | S | | 10/2002 | Lin | |
| 6,461,216 | B1 | | 10/2002 | Applewhite et al. | |
| 6,491,562 | B1 | | 12/2002 | Jackson | |
| D480,437 | S | | 10/2003 | Stoneberg | |
| D484,886 | S | | 1/2004 | Matsuoka | |
| D510,392 | S | | 10/2005 | Hussaini | |
| 7,044,827 | B1 | * | 5/2006 | Krull | A63B 23/16 446/491 |
| D539,757 | S | | 4/2007 | Mayo | |
| D564,458 | S | | 3/2008 | Nakabou | |
| 7,361,075 | B1 | | 4/2008 | Krull | |
| D584,312 | S | | 1/2009 | Bishop | |
| 7,601,045 | B2 | * | 10/2009 | Zawitz | A63H 33/00 446/121 |
| D606,029 | S | | 12/2009 | Chou | |
| D667,382 | S | | 9/2012 | Cosentino | |
| D698,869 | S | | 2/2014 | Strzelewicz | |
| D725,049 | S | | 3/2015 | Paredes | |
| D742,336 | S | | 11/2015 | Panis | |
| D760,825 | S | | 7/2016 | Solorzano et al. | |
| D765,189 | S | | 8/2016 | Kiribuchi | |
| D781,251 | S | | 3/2017 | Tsuduki | |
| D806,178 | S | * | 12/2017 | Chow | D21/460 |
| D818,054 | S | * | 5/2018 | McLachlan | D21/468 |
| D827,725 | S | | 9/2018 | McLachlan et al. | |
| D827,726 | S | | 9/2018 | McLachlan et al. | |
| D827,727 | S | | 9/2018 | McLachlan et al. | |
| D829,828 | S | * | 10/2018 | McLachlan | D21/468 |
| 10,086,641 | B1 | * | 10/2018 | Vazquez | B43K 29/00 |
| D837,306 | S | | 1/2019 | Patison | |
| D857,804 | S | | 8/2019 | McLachlan et al. | |
| D858,650 | S | | 9/2019 | McLachlan et al. | |
| D859,537 | S | | 9/2019 | McLachlan et al. | |
| 11,278,792 | B2 | * | 3/2022 | McLachlan | A63H 31/00 |
| 2001/0009866 | A1 | * | 7/2001 | Klitsner | A63F 9/24 463/35 |
| 2004/0106091 | A1 | * | 6/2004 | Weiner | A63F 9/0413 434/169 |
| 2004/0259466 | A1 | * | 12/2004 | Maxwell | A63H 33/042 446/487 |
| 2006/0093995 | A1 | * | 5/2006 | Brown | G09B 1/36 434/171 |
| 2009/0203294 | A1 | * | 8/2009 | Kessin | A63H 33/006 434/258 |
| 2010/0279826 | A1 | * | 11/2010 | Weinstock | A63B 23/16 482/47 |
| 2015/0065009 | A1 | * | 3/2015 | Chase | A63H 3/52 446/444 |
| 2015/0202544 | A1 | * | 7/2015 | Snee, Jr. | A63H 33/00 434/236 |
| 2016/0232804 | A1 | * | 8/2016 | Nichols | A61H 7/001 |
| 2018/0193998 | A1 | | 7/2018 | Shin | |
| 2018/0224881 | A1 | | 8/2018 | Jensen | |

FOREIGN PATENT DOCUMENTS

| | | |
|---|---|---|
| DM | 096997 | 3/2017 |
| JP | D1236629 | 4/2005 |

OTHER PUBLICATIONS

Quayle Action, U.S. Appl. No. 29/636,892, dated Mar. 12, 2018.
Notice of Allowance, U.S. Appl. No. 29/663,697, dated Apr. 10, 2019.
Notice of Allowance, U.S. Appl. No. 29/663,704, dated Apr. 12, 2019.

* cited by examiner

HANDHELD TOUCH APPARATUS WITH MOVABLE TACTILE FEATURES

CROSS-REFERENCE TO RELATED APPLICATIONS

This application is a continuation of U.S. application Ser. No. 16/332,656, filed Mar. 12, 2019, which is a 371 national stage entry of PCT/US2017/049461, filed Aug. 30, 2017, which claims the benefit of U.S. Provisional Patent Application No. 62/495,418, filed Sep. 13, 2016, and U.S. Provisional Patent Application No. 62/467,721, filed Mar. 6, 2017, and is a continuation-in-part of U.S. Design patent application Ser. No. 29/590,129, filed Jan. 6, 2017, now U.S. Design Pat. No. D818054, each of which is incorporated by reference in its entirety herein and for all purposes.

FIELD OF THE INVENTION

The present invention generally relates to a cube-shaped handheld touch apparatus having a plurality of manually-movable tactile features extending from adjacent or opposing surfaces thereof, and that may be used as a fidget toy, a stress relief toy, or a play toy, as well as a hand therapy device or exerciser.

BACKGROUND

In the modern lifestyle people have become accustomed to being busy and occupied for much of the time. This can be exacerbated by devices such as cell phones and other electronic devices and the widespread availability and access to the Internet. As a result, some people have as yet attained only a limited capacity for occupying themselves in a passive manner, e.g. by observing the world around them and engaging in thought, and may tend to fidget and get restless when they are not otherwise occupied. This fidgeting and restlessness can lead, in some circumstances, to activities and overt behaviors may be distracting or annoying to others in their immediate surrounds. In addition, even people with the capacity for passive self-occupation may nevertheless experience periods of stress and excess emotional energy that make it difficult to properly focus on the task at hand. In both situations it may be considered desirable or beneficial to devise alternative methods or means for releasing this built-up stress energy, for occupying a minor portion of one's mind so as to allow the remainder to better focus and concentrate on one or more tacks, or for redirecting this modern restlessness habit for fidgeting into outlets having less socially-obtrusive characteristics.

Consequently, a need exists for a method, device or apparatus that can address at least some of the needs described above or provide the public with a useful alternative. It is toward such an apparatus that the present disclosure is directed.

SUMMARY

Briefly described, one embodiment of the present disclosure comprises a handheld touch apparatus for providing a variety of tactile sensations to the fingers, thumb, and palm of a hand of a user. The touch apparatus generally includes a cubic body having a substantially continuous outer surface defined by a plurality of faces that are planar and orthogonal to one another and joined together by radiused edges that meet together to form rounded corners. The cubic body is also sized for holding within the palm of the user's hand and for being supported, rotated and manipulated by the fingers and thumb of the same hand. The touch apparatus further includes a plurality of tactile features extending from the faces of the cubic body and that are selectively movable relative to their associated faces by one of more of the user's fingers. In one aspect each of the tactile features is contained within a volume of an imaginary sphere defined by the rounded corners of the cubic body, and with each tactile feature being isolated from the tactile features on adjacent faces by the radiused edges of the cubic body, so that the tactile feature is only accessible to a finger or thumb of the user through exposure of the face from which it extends.

Another embodiment of the disclosure includes a handheld touch apparatus for providing a variety of tactile sensations to the fingers, thumb, and palm of a hand of a user. The touch apparatus generally includes a cubic body having a substantially continuous outer surface defined by a plurality of faces that are planar and orthogonal to one another and joined together by radiused edges that meet together to form rounded corners. The cubic body is also sized for holding within the palm of the user's hand and for being supported, rotated and manipulated by the fingers and thumb of the same hand. The touch apparatus further includes at least five tactile features extending from five of the six faces of the cubic body that are selectively movable relative to their associated faces by one of more of the user's fingers, as well as a non-movable tactile feature formed into a sixth face of the cubic body.

The invention will be better understood upon review of the detailed description set forth below taken in conjunction with the accompanying drawing figures, which are briefly described as follows.

Those skilled in the art will appreciate and understand that, according to common practice, various features and elements of the drawings described above are not necessarily drawn to scale, and that the dimensions and relative positions between the features or elements may be expanded, reduced or otherwise altered to more clearly illustrate the various embodiments of the present disclosure depicted therein.

DETAILED DESCRIPTION

The following description, in conjunction with the accompanying drawings described above, is provided as an enabling teaching of exemplary embodiments of a handheld touch object or apparatus, and one or more methods for making or using the handheld touch apparatus. As described below, the handheld touch apparatus can provide several significant advantages and benefits over other devices for occupying a restless user, improving concentration and focus, and/or for releasing stress energy. However, the recited advantages are not meant to be limiting in any way, as one skilled in the art will appreciate that other advantages may also be realized upon practicing the present disclosure.

Furthermore, those skilled in the relevant art will recognize that changes can be made to the described embodiments while still obtaining the beneficial results. It will also be apparent that some of the advantages and benefits of the described embodiments can be obtained by selecting some of the features of the embodiments without utilizing other features, and that features from one embodiment may be combined with features from other embodiments in any appropriate combination. For example, any individual or collective features of method embodiments may be applied to apparatus, product or system embodiments, and vice versa. Accordingly, those who work in the art will recognize that many modifications and adaptations to the embodiments described are possible and may even be desirable in certain circumstances, and are a part of the disclosure. Thus, the present disclosure is provided as an illustration of the principles of the embodiments and not in limitation thereof, since the scope of the invention is to be defined by the claims.

Figure 1:
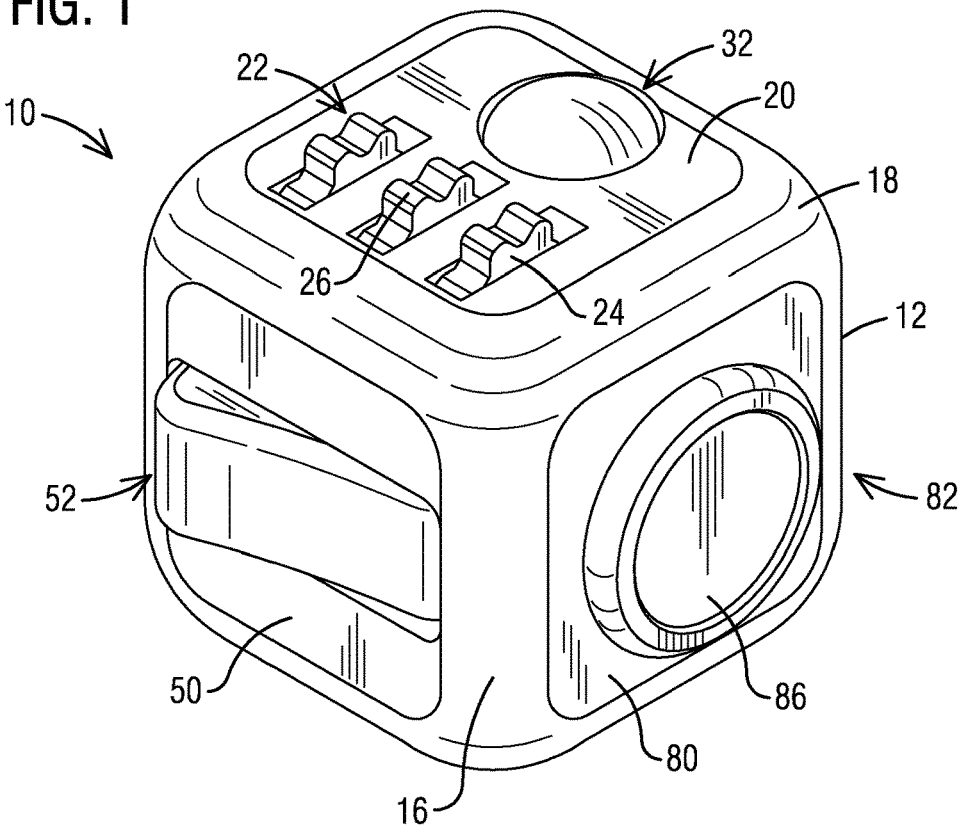
FIG. 1 is a perspective view of a handheld touch apparatus showing three faces thereof, in accordance with a representative embodiment of the present disclosure.
Figure 2:
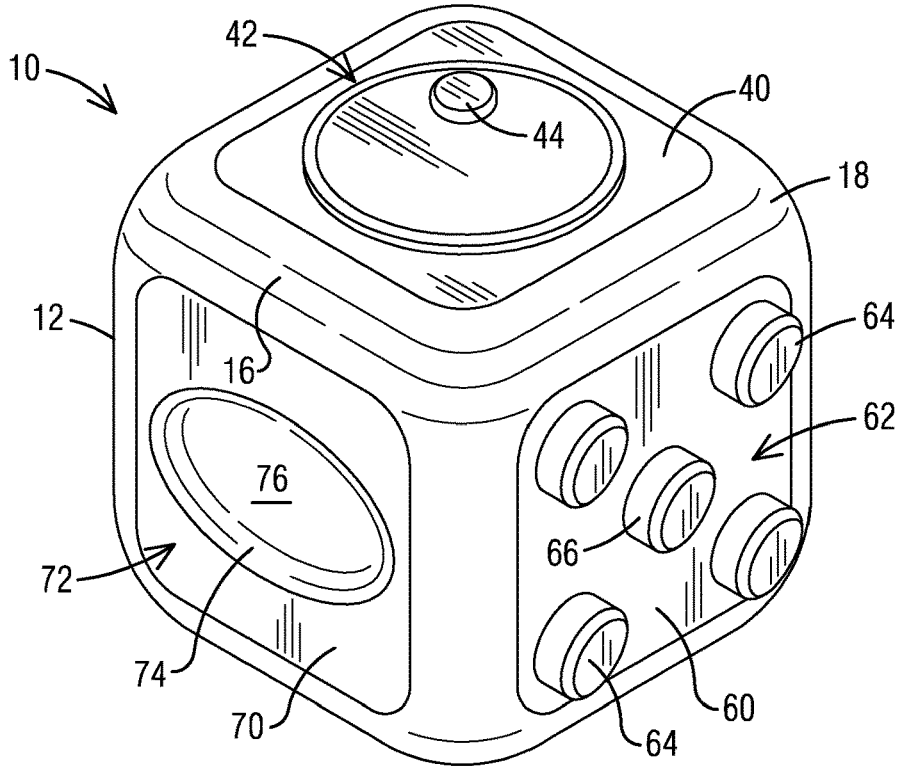
FIG. 2 is another is a perspective view of the handheld touch apparatus of FIG. 1 showing the opposite three faces thereof.

Referring now in more detail to the drawing figures, wherein like parts are identified with like reference numerals throughout the several views, FIGS. 1-2 are perspective views of a handheld touch object or apparatus 10 generally comprising a body 12 in the form of a multi-faceted block. In one aspect the body 12 may be in the form of a substantially rectangular block, e.g. preferably a cube, forming six substantially planar faces 20, 40, 50, 60, 70 and 80 of identical perimeter shape.

As illustrated in the drawings, a different tactile feature or features for contact and/or manual manipulation (e.g. movement) can be presented at or on each of the six faces 20, 40, 50, 60, 70 and 80. Alternatively only some of the faces may present a tactile feature and some faces may present a flat face with no tactile feature. The body 12 may also comprise radiused edges 16 and rounded corners 18. For example, each edge 16 located between two adjacent faces can be rounded (i.e. include a radius) to provide a rounded and smooth 90 degree transition between two adjacent faces and to provide for comfortable holding and manipulation of the touch apparatus 10 within the palm of the hand of a user. In one aspect the rounded or radiused edges can serve to separate or isolate the one or more tactile features on one face from the tactile features on an adjacent face, so that each tactile feature is presented only on a single face. Furthermore, and as will be discussed in more detail below, the rounded corners 18 can also define the diameter, surface, or volume of an imaginary sphere within which all of the tactile features can be maintained.

As with many of the other 'fidget' devices known in the art, the handheld touch apparatus 10 of the present disclosure can be grasped in one hand and manipulated by the other hand of the user. The apparatus may also be placed on a surface, such as a table or desk, and then have one or more of its tactile features manipulated with either hand. Nevertheless, it will be appreciated that the handheld touch apparatus 10 can be advantageously sized for holding within the palm of a single hand of the user, and for being rotated and manipulated by the fingers and thumb of the same hand, so as to provide a variety of tactile sensations to the fingers, thumb, and palm of the user's hand while the other hand is engaged in other activities, such as, for instance, holding a mobile phone, manipulating a computer mouse, or typing on a keyboard.

Figure 3:
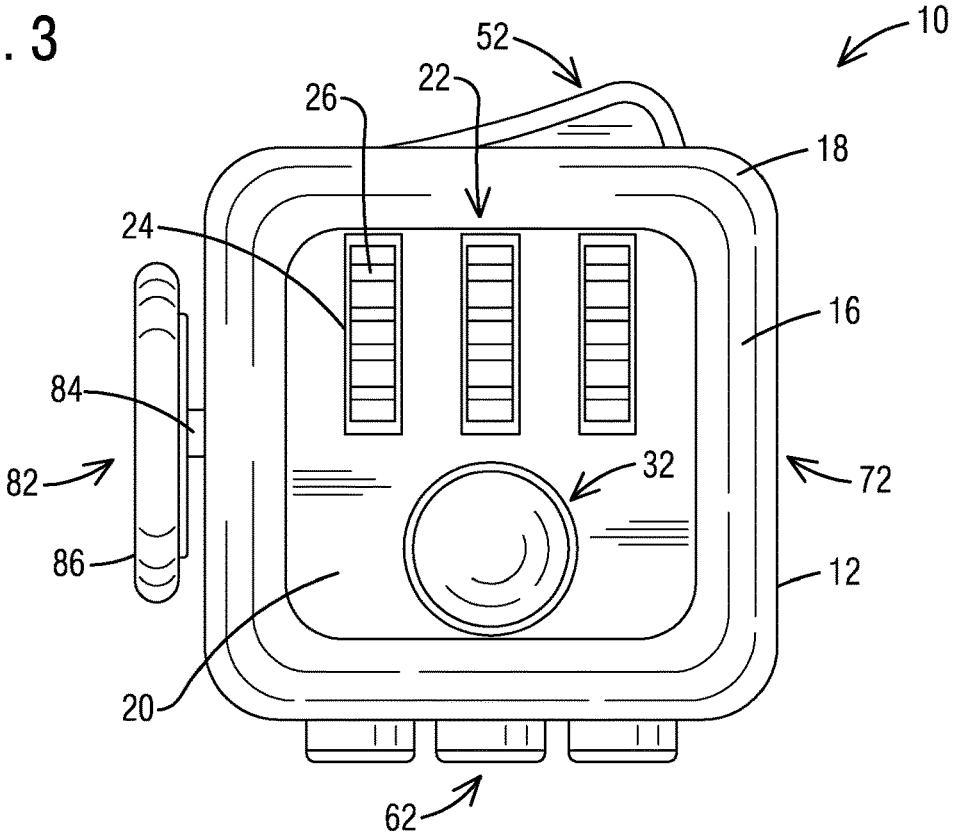
FIG. 3 shows a front elevation view or first face of the handheld touch apparatus of FIGS. 1 and 2.

As shown in FIGS. 1 and 3, the apparatus 10 has a first substantially planar face 20 at which at least one tactile feature may be presented, including but not limited to one or more dials 22. The dials (preferably in the form of a gear 24 having teeth 26 presented at its perimeter) can be manually manipulated by the user. In the illustrated form shown in FIG. 3, for example, a plurality of dials 22, i.e. a set of dials thereon that can be manually moved by a user's fingers, are presented at the first face 20. The set of dials 22 can be similar to those found in mechanical devices such as combination locks. In the illustrated form, the three dials 22 are arranged in a row. Moreover, the dials 22 can be rotatable in one or two directions. In the illustrated form shown in FIG. 3, the dials 22 are arranged for dual direction movement (i.e. dual direction rotation). Alternatively the dials 22 may be constrained for a single direction movement (i.e. single direction rotation). The dials 22 may be arranged to rotate about an axis that is parallel to their associated face 20. Thus, in one aspect the movement of the dials 22 relative to their associated face 20 may be limited to rotation about an axis that is parallel to the plane of its associated face 20.

The dials 22 may comprise one or more teeth 26 to be like a gear 24. The teeth can provide bearing features or bearing points for a user to push against as the user manipulates or interacts with the gear 24. The teeth on one gear may be equidistant and evenly spaced around the circumference of the gear. In one aspect all the gears 24 may be identical and include the same number of teeth. Alternatively at least one gear 24 may include more teeth than the other gears or at least one gear may include larger sized teeth than the other gears. The dials 22 or gears 24 may also provide an audible click sound as one or more of the dials 22 are rotated. In an alternative form one or more dials 22 may be silent when rotated or manipulated and may not provide an audible feedback.

The first face 20 may also have a ball or rollerball 32 mounted thereon capable of a rolling movement. The ball or rollerball 32 may be rolled by a user in any direction by manual manipulation by a user. In one aspect the rollerball 32 is preferably able to be subject to omnidirectional movement but alternatively may be constrained for unidirectional or bidirectional movement. In addition, the rollerball may also be pressed down, towards the center of the body 12 and when released it reverts to its original rest position. The rollerball 32 is preferably mounted on or coupled to a biasing member or members that bias the rollerball 32 back to its original rest position. The rollerball 32 may provide some audible feedback such as a sound when the ball is pressed.

In the embodiment of the touch apparatus 10 shown in FIGS. 1-8, the first planar face 20 can be subdivided into two halves, with the one or more dials 22 or gears 24 being positioned on one half and the rollerball 32 being positioned on the other. This can allow a user to run a thumb or finger first over the rollerball 32 and then immediately onto the gears 24, thereby creating an interesting or pleasing tactile sensation of touching a smooth hard rolling surface immediately followed by a contrasting rough hard rolling surface, all in the same short movement. Moving a thumb or finger in the opposite direction can create a reversed sequence of tactile sensations. If positioned correctly, it may even possible for a user to touch and/or manipulate both tactile features 22, 32 presented on the first planar surface 20 at the same time. Such a configuration can beneficially provide for a variety of tactile sensations and sequences that help maintain a user's interest in touching and manipulating the tactile features on the first face 20.

Nevertheless, it will be appreciated that the one or more gears 24 and the rollerball 32 could also be presented on different faces, either individually or in combination with different tactile features, as discussed in more detail below.

Figure 4:
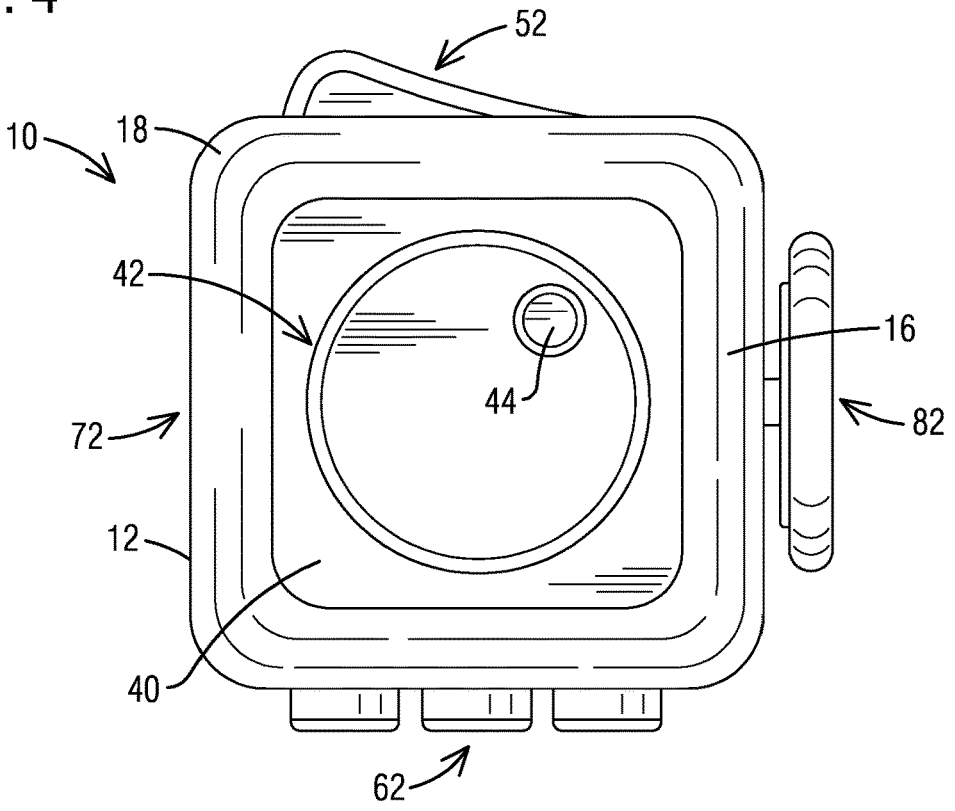
FIG. 4 shows a back elevation view or second face of the handheld touch apparatus of FIGS. 1 and 2.

As shown in FIGS. 2 and 4, a second face 40 of the body 12, preferably opposed to the first face 20, also has a tactile feature presented at the face 40. The tactile feature can be a turning disk 42 (preferably in the form of a dial) rotatably mounted thereon. In one aspect the turning disk 42 may be mounted substantially flush with the face 40 of the body 12 and is capable of being manually turned and rotated on the face by the finger of a user, wherein the finger could be any one of the user's five fingers. Alternatively the turning disk or dial 42 may be mounted slightly proud of the face 40. The rotation axis of the turning disk 42 is generally normal to the plane of the second face 40. Thus, in one aspect the movement of the turning disk 42 relative to its associated face 40 may be limited to rotation about an axis that is perpendicular to the plane of its associated face 40.

The turning disk 42 can further include a gripping tab in the form of a small protrusion 44 projecting up therefrom for assisting a user to grip the disk 32 and rotate it relative to the face 40. The protrusion 44 is generally located adjacent or near to the circumferential edge of the disk 42 but alternatively may be spaced from the circumferential edge and spaced away from the center of the disk 42. In an alternative form the turning disk 42 may include multiple gripping tabs positioned around the disk 42 and where gripping tabs are protrusions. The gripping tabs may be equally spaced around the circumference or may be randomly distributed around the disk or dial 42.

Figure 5:
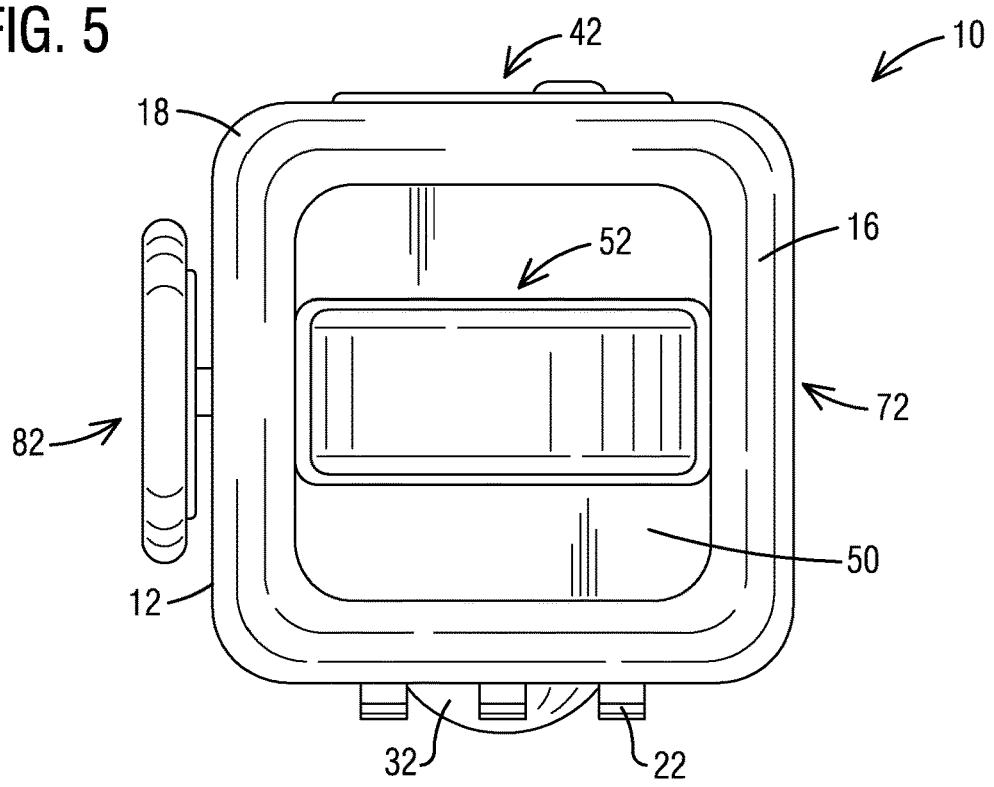
FIG. 5 shows a top plan view or third face of the handheld touch apparatus of FIGS. 1 and 2.

As shown in FIGS. 1 and 5, a third face 50 of the body 12 preferably has another tactile feature that can be a switch 52. Preferably the switch 52 extends across the full side face 50. In one aspect the switch 52 may be a toggle switch. The switch 52 can be pivoted by manual manipulation by a user between two positions that mimics an equipment control switch being shifted between on and off positions. The axis of rotation of the switch 52 is generally parallel to the third face 50. Thus, in one aspect the movement of the switch 52 relative to its associated face 50 may also be limited to rotation about an axis that is parallel to the plane of its associated face 50.

Figure 6:
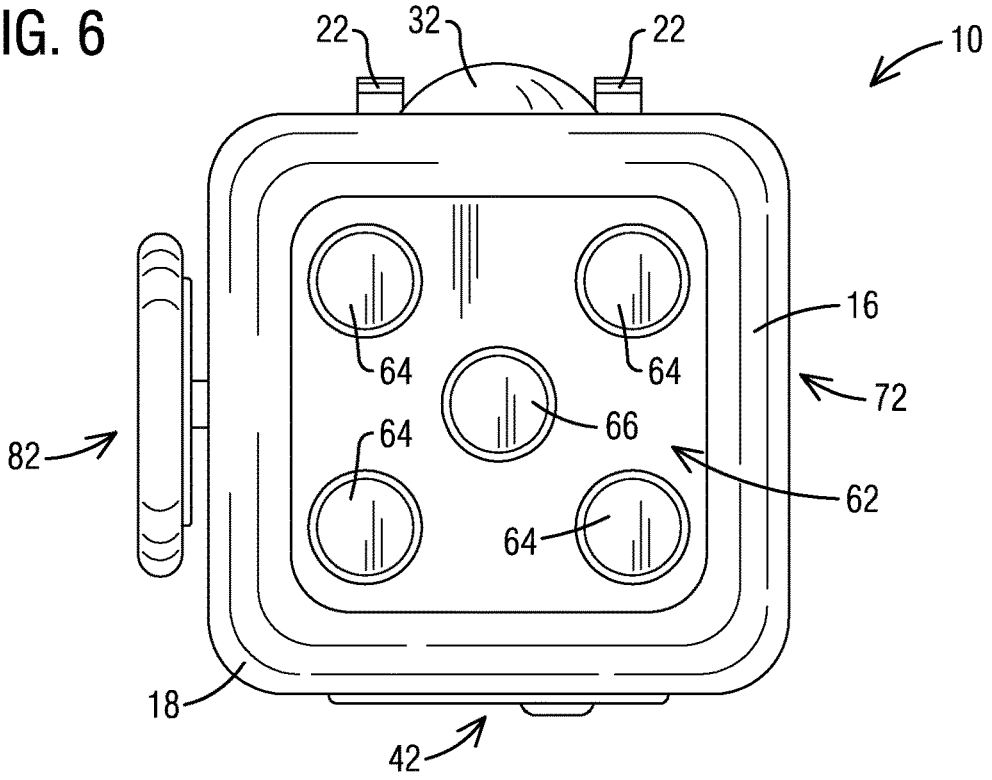
FIG. 6 shows a bottom pan view or fourth face of the handheld touch apparatus of FIGS. 1 and 2.

The fourth face 60 of the body 12, opposed to the third face 50 in FIG. 5, is shown in FIGS. 2 and 6. The fourth face 60 may present a tactile feature that can comprise a plurality of buttons 62. These are preferably arranged in the form of an array. In the illustrated embodiment, there are four buttons 64 delimiting a notional square and a fifth button 66 positioned centrally within the notional square. The buttons 62 can be moveable inward toward the middle of the body 12 and while being biased outward toward the fourth face 60. Thus, in one aspect the movement of the buttons 62 relative to their associated face 60 may also be limited to translation along axis that is perpendicular to the plane of its associated face 60.

One or more of the buttons 62 may also provide a tactile feedback when pushed and/or may provide an audible feedback such as, for example, an audible click when pushed inward. In one aspect selected buttons from the five buttons 62 can make an audible click and while other selected buttons make no sound. At least two of the buttons 62 may provide an audible and tactile feedback when pushed or depressed by a user and at least two of the buttons 62 provide a tactile feedback and no audible feedback when pushed or depressed. The height of the buttons above the fourth face 60 after being pushed inward can also vary. In addition, one or more of the push buttons 62 may also provide a visual feedback when pushed or depressed.

Figure 7:
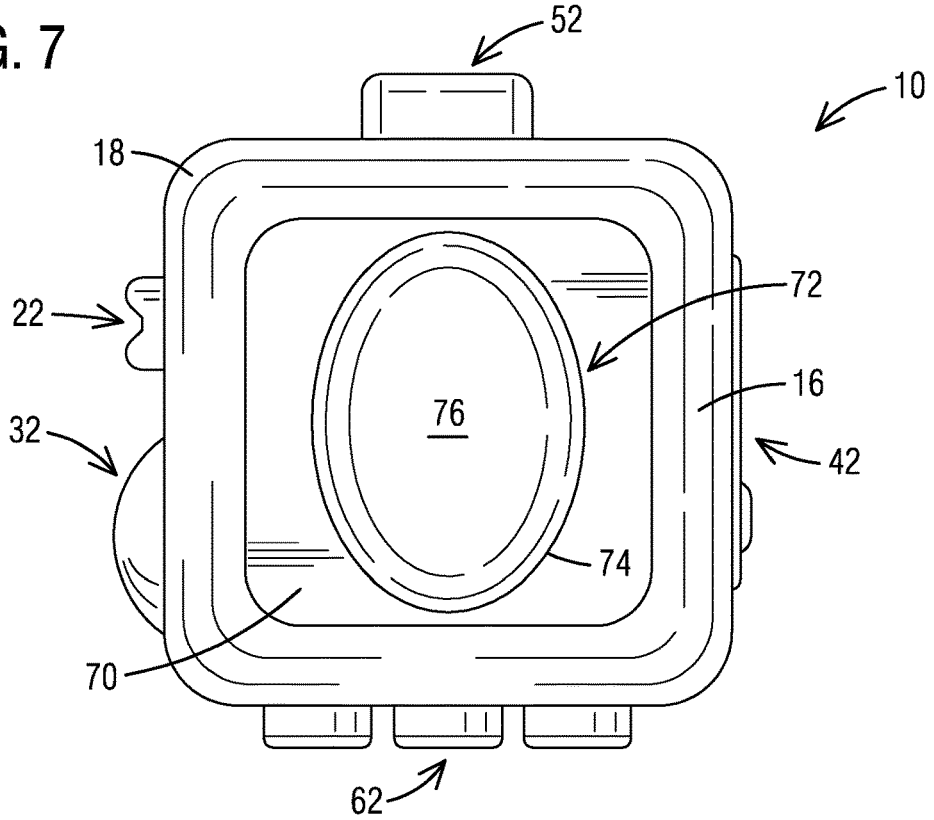
FIG. 7 shows a right side view or fifth face of the handheld touch apparatus of FIGS. 1 and 2.

As shown in FIGS. 2 and 7, a fifth face 70 of the body 12 has another tactile feature that can be a shallow recess 72. The recess 72 may have an interesting or unique tactile feel or a surface finish that is different to the rest of the body. In one aspect the recess 72 may have a different tactile feel to the outer surfaces of the body 12, for example the recess may be smoother or rougher than the surface of the fifth face 70. The recess 72 can have an oblong or oval shape, and can also include transition regions 74 extending between the fifth face 70 and a base 50 of the recess 72. The transition regions 74 may be rounded or provide a smooth transition from the face 70 to the base 76 of the recess 72. As noted above, the recess base 76 may include a surface finish that may be different to the surface finish of one or more faces of the body 12. For example the recess base 76 may be rougher or smoother than the fifth face 70, thereby providing a user with a different or contrasting tactile sensation when the user touches (i.e. manipulates) the recess. This tactile feature 72 may mimic a worry stone. When fidgeting, a user can manually run their finger along and/or around the shallow recess 72 in the same way that they would do for a worry stone, to calm and soothe the emotions, or in the alternative press firmly into the recess 72 so as to release stress.

Figure 8:
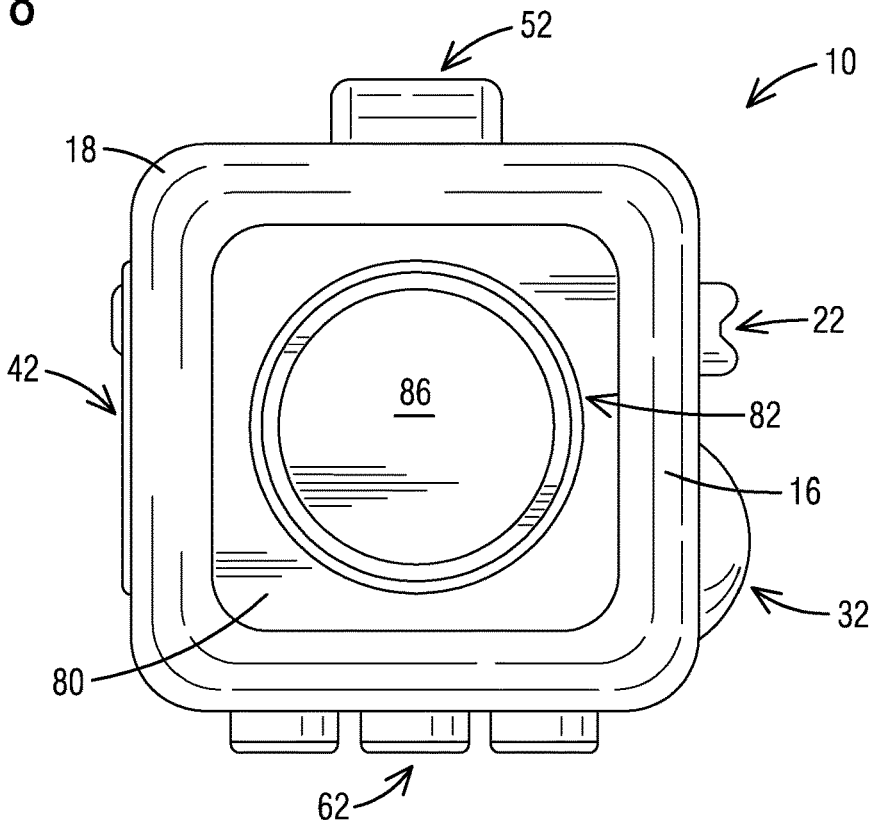
FIG. 8 shows a left side view or sixth face of the handheld touch apparatus of FIGS. 1 and 2.

As shown in FIGS. 1 and 8, a sixth face 80 of the body 12 may have another tactile feature that can be a joystick 82. The joystick preferably comprises an axle 84 projecting outwardly from the sixth face 80 (as seen in FIGS. 5 and 7) and at the end of which may be presented a disk 86. The disk 86 preferably sits proud of the sixth face 80. The disk may alternatively be of another shape that a user can touch and/or grasp. The joystick may be flexibly or rotationally mounted on the body 12, with the disk 86 spaced a small distance above the sixth face 80 of the body, which can be manually manipulated by a user. Typically a user might push back and forth or around in a circle using the flat surface of the disk 86 of the joystick 82. This fidget feature mimics joy sticks that are used in computer games and would be known to computer game users. Thus, the movement of the joystick 82 relative to its associated face 80 can include translation in any direction that is parallel to the plane of its associated face 80.

Moreover, in one aspect a user may also rotate the disk 86 slightly by twisting the circumference of the disk 86. This may be accomplished by holding the body 12 with two hands and using both thumbs to push opposite edges of the disk 86 in opposite directions.

Figure 9:
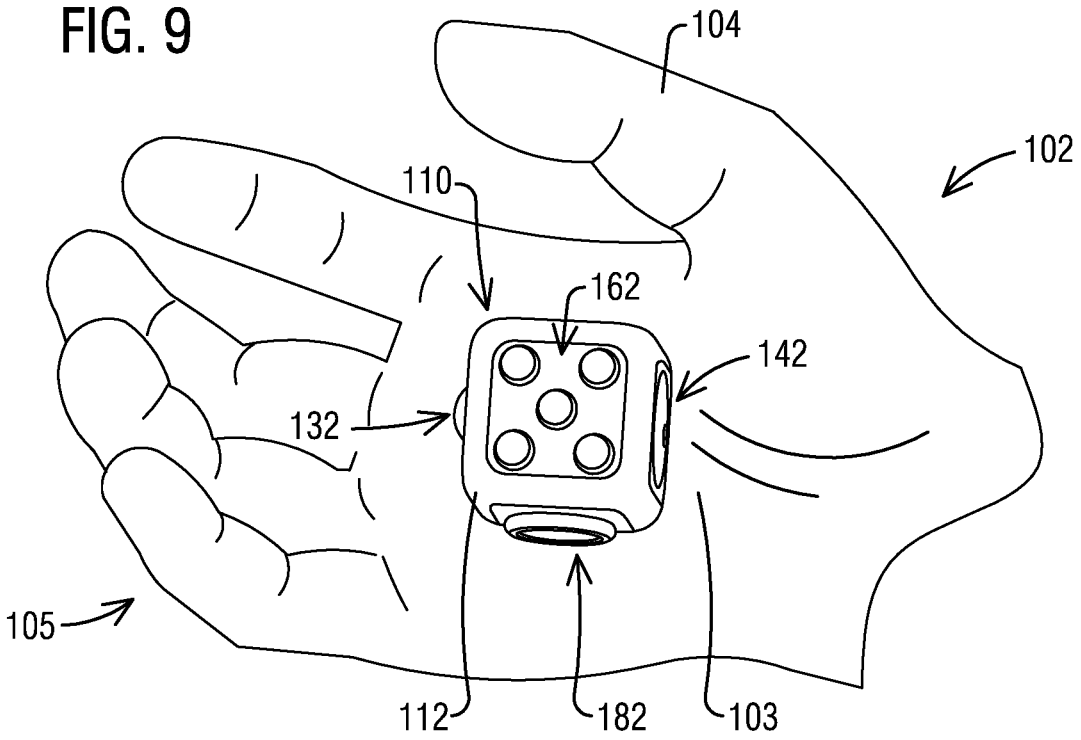
FIG. 9 is a drawing of the handheld touch apparatus being held in within the palm of the hand of a user, in accordance with another representative embodiment of the present disclosure
Figure 10:
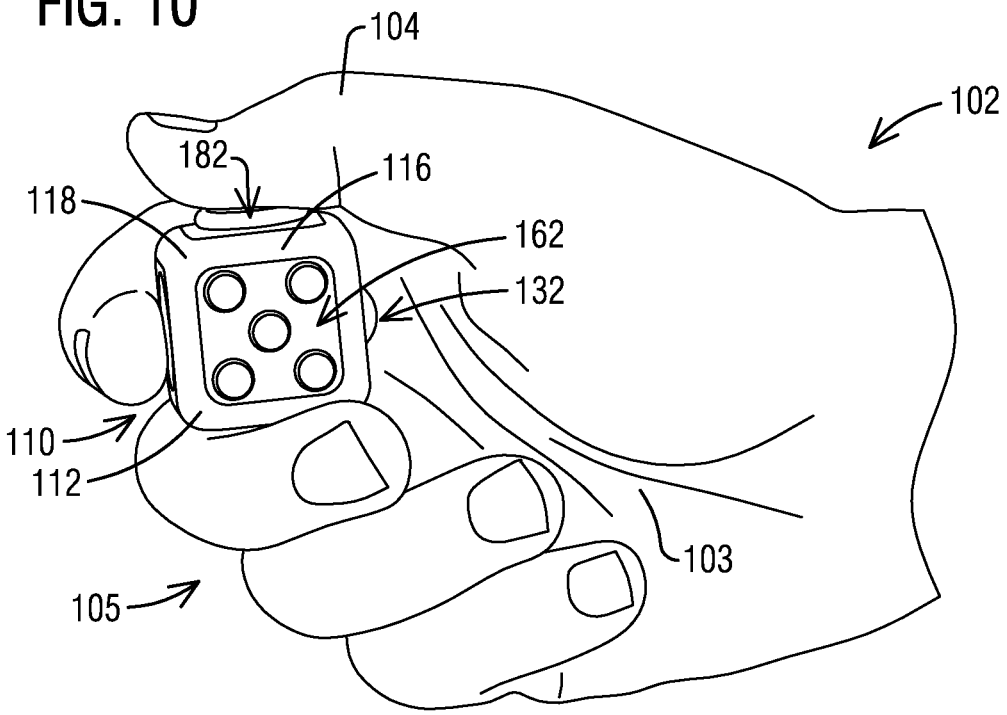
FIG. 10 is a drawing of the handheld touch apparatus of FIG. 9 being held between the fingers, thumb, and outer palm of the same hand of the user.
Figure 11:
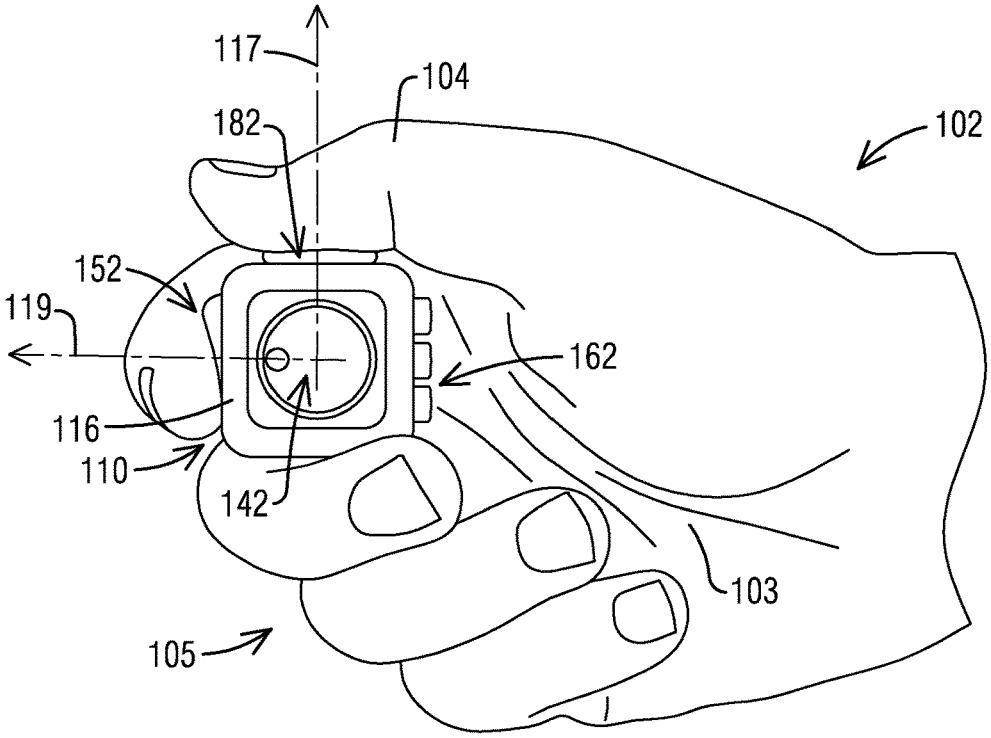
FIG. 11 is a drawing of the handheld touch apparatus of FIG. 10 being held between the fingers, thumb, and outer palm of the same hand of the user, but after a 90 degree rotation about a vertical axis by the fingers of the user.
Figure 12:
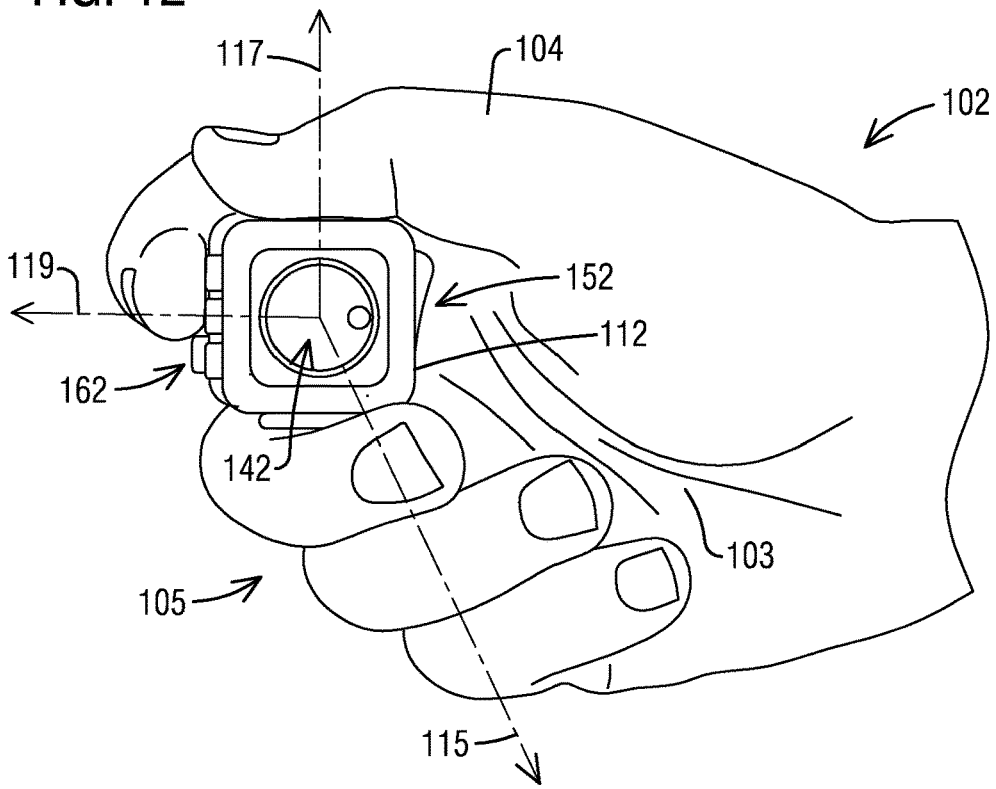
FIG. 12 is a drawing of the handheld touch apparatus of FIG. 11 being held between the fingers, thumb, and outer palm of the same hand of the user, but after a 180 degree rotation about a horizontal axis by the fingers and thumb of the user.
Figure 13:
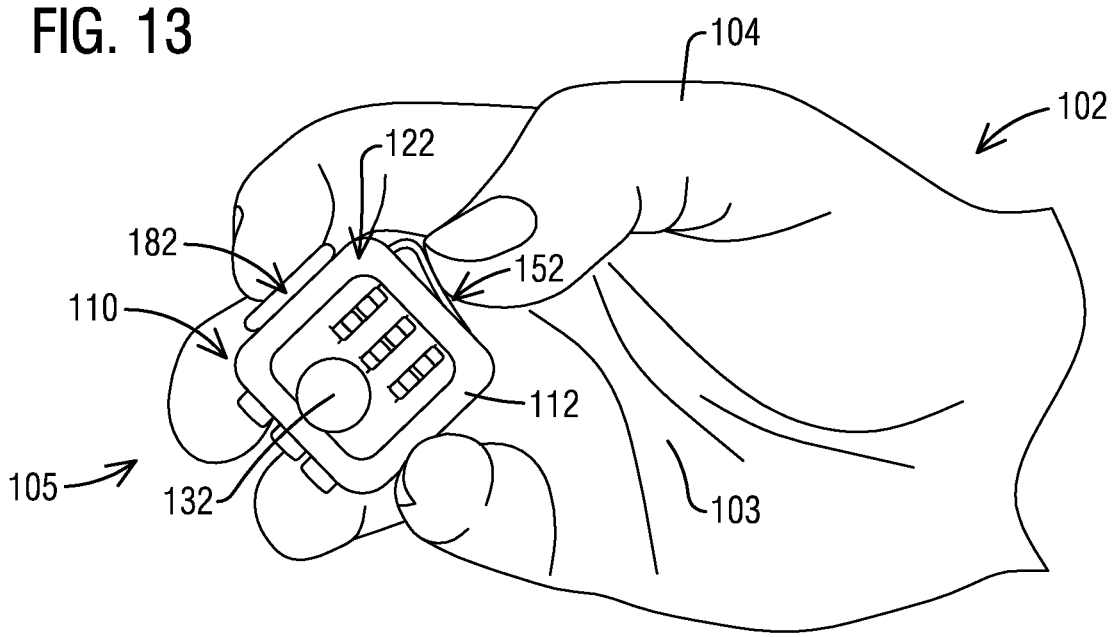
FIG. 13 is a drawing of the handheld touch apparatus of FIG. 9 being held and manipulated by the outer ends of the thumb and fingers of the hand of the user.
Figure 14:
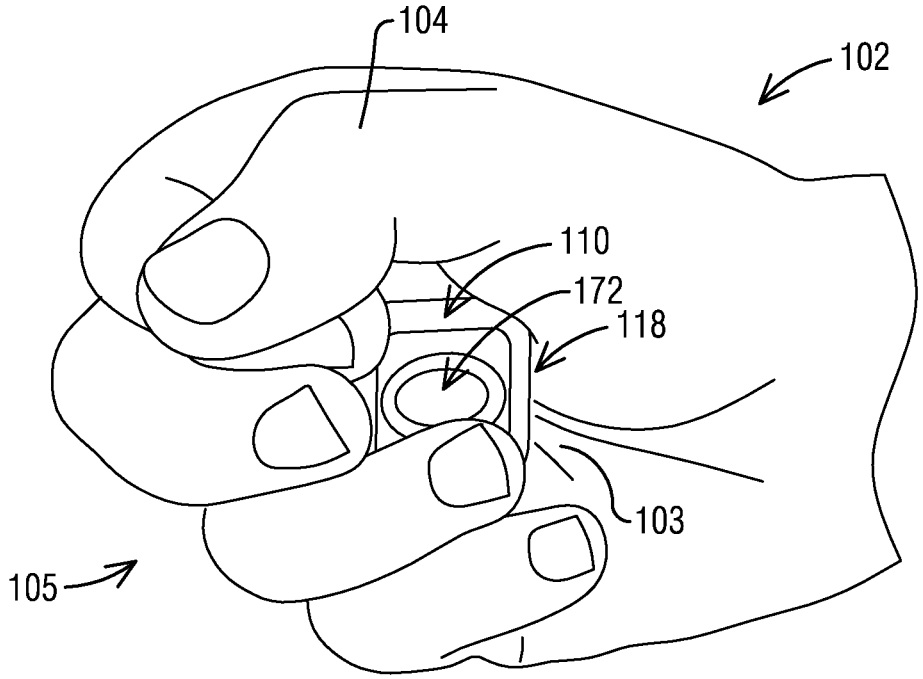
FIG. 14 is a drawing of the handheld touch apparatus of FIG. 9 being substantially surrounded by the palm and fingers of the hand of the user as it is being gripped and squeezed.

In use, the handheld touch apparatus can be manually used by a user to occupy one or both of their hands. As illustrated with the embodiment 110 of the handheld touch apparatus shown in FIGS. 9-14, the user typically grasps the touch apparatus 110 in their hand 102 and uses their thumb 104 and/or 105 fingers to manipulate the tactile features that may be presented at the different faces. Furthermore, it will be appreciated that the handheld touch apparatus 110 can generally be smaller and more compact than many other commonly-known fidget devices. For example, the apparatus 110 may be sized for being held within the palm 103 of a hand 102 (FIG. 9), for being simultaneously held and supported by the fingers 105, thumb 104, and outer portions of the palm 103 of the same hand (FIGS. 10-12), for being held and manipulated by the outer ends of the thumb and fingers (FIG. 13), and for being substantially surrounded by the palm 103 and fingers 105 of the hand when it is gripped for squeezing (FIG. 14).

As stated above, the handheld touch apparatus 110 can generally be smaller and more compact than other fidget devices known in the art. For instance, the area of one face of the touch apparatus 110 may occupy between ⅙th to ⅓rd the area of an average user's palm 103 when the touch apparatus 110 is placed flat on the palm 103. More specifically, in one aspect each face of the handheld touch apparatus 110 can have a width and a height ranging from about 2.5 cm to about 4.5 cm, and preferably a width and a height of about 3.3 cm. The width of each face of the touch apparatus 10 may be between 2 cm and 5 cm. More preferably each face of the touch apparatus 10 has width that may be between 2.5 cm and 4.5 cm. Even more preferably each face of the touch apparatus 10 has a width of between 2.8 cm and 3.5 cm. As with the illustrated embodiment of the touch apparatus 110 shown in FIGS. 9-14, each face can have a width of about 3.3 cm. Since the illustrated embodiment 110 is preferably a cube shaped touch apparatus, each face can also have an equal height and width, and each face can be identical in plan perimeter shape.

The different tactile features can provide a wide variety of different user experiences, and a user can continuously manipulate or rotate the handheld touch apparatus 110 to select a tactile feature that best fits his or her preference at that moment. For example, the shallow recess 172 with its tactile feel mimicking a worry stone, contrasts with the deliberate action of switching the toggle switch 152 on and off repeatedly. Further the user could conceivably interact with the tactile features on two opposed faces of the body at one time, with different fingers of one hand or different fingers of two hands. For example, in the illustrated embodiment, the user might interact with (or manipulate) the push buttons 162 on one face and the toggle switch 152 on the opposed face simultaneously. Accordingly, one or more of the tactile features may provide a tactile (i.e. haptic feedback) when manipulated. In addition, one or more of the tactile features may provide an audible feedback when manipulated for example an audible click. One or more of the tactile features described herein may also provide a visual feedback when manipulated.

It will be appreciated, moreover, that one or more of the tactile features described herein may provide either one or two or all three of a tactile feedback, audible feedback and visual feedback. For example the recess 172 generally provides a tactile feedback. The toggle switch 152 can provide an audible feedback, tactile feedback and a visual feedback. Similarly the turning disk 134 can also provide a tactile, audible and visual feedback. The push buttons 162 preferably provide a tactile and audible feedback. Other combinations are also possible and considered to fall within the scope of the present disclosure.

With the exception of the shallow recess 172 that is formed into the right side or fifth face 170 of the embodiment of the touch apparatus 110 illustrated in FIGS. 9-14, each of the tactile features 122, 132, 142, 152, 162, and 182 can extend from the outer surface of one of the faces of the touch apparatus 110, and can be movable relative to its associated face by the thumb 104 or a finger 105 of the hand 102 of the user while the body 112 is supported by the other fingers, the thumb, or the palm of the same hand of the user. As discussed above, moreover, the touch apparatus 10 also can be advantageously sized for being rotated or pivoted or repositioned by the fingers and thumb of the same hand. In this way the touch apparatus 110 can be periodically and repeatedly pivoted or rotated by the fingers and thumb of a user's hand to expose a number of different faces and tactile features to these same fingers and thumb, so as to provide a variety of tactile sensations to one hand of the user while the opposite hand is engaged in other activities, such as, for instance, holding a mobile phone, manipulating a computer mouse, or typing on a keyboard, and the like.

It will be appreciated that the positioning of each tactile feature on a single face of the body 112 causes each tactile feature to be isolated from the tactile features on the adjacent faces by the radiused edges 116 of the body 112, and not directly accessible from any another face of the body. Moreover, when this feature is combined with five or more additional tactile features that are each different and distinct from the others, and with all but one of these additional tactile features being movable in some way relative to their associated face, the sequence of discrete tactile sensations provided to the user can be far more variable, interesting, and stimulating to a user than those provided by other fidget objects or devices.

Furthermore, it will also be appreciated that a user can also learn to repetitively manipulate a number of the tactile features on different faces of the touch apparatus body 112, either simultaneously or in a desired sequence, to achieve a desired feedback. This activity may be undertaken using either different fingers of one hand, different fingers of two hands, or both. For example, with the embodiment of the tactile apparatus illustrated in FIGS. 9-14, a user might simultaneously interact with (or manipulate) the push buttons 162 on the fourth face 160 using a thumb and the toggle switch 152 on the opposed third face 50 using the middle finger, while at the same time stabilizing the apparatus 110 with the index finger pressed against the disk of the joystick 182 presented on the sixth face 180. The user could then rotate the body 112 of the touch apparatus 110 by 90 degrees around two different axes so that the thumb could simultaneously interact with the rollerball 132 and gears 124 on the first face 120 while the index finger interacted with the toggle switch 152 on the third face 150 and the middle finger interacted with the turning disk 152 on the second face 150. It will be appreciated that a wide variety of additional simultaneous multi-tactile feature interactions are also possible.

As described above, the embodiment of the touch apparatus 110 shown in FIGS. 9-14 can include movable tactile features 122, 132, 142, 152, 162, and 182 extending from five faces 120, 140, 150, 160, and 180 of the body 112, as well as a non-movable tactile feature 172 formed into the sixth face 170. Thus, in one aspect of the present disclosure a user can position the touch apparatus 100 with any of the movable tactile features being selectively movable relative to its associated face by a thumb 104 or finger 105 of the hand 102 of a user, while the body 112 is supported in a first orientation by the other fingers 105 or the palm 103 of the same hand of the user, and with a first axis of rotation 115 of the body projecting out of the plane of the associated first face (see FIG. 11). It will be appreciated that the body 112 can then rotatable in at least one angular direction around each of a second axis 117 and third axis 119 of rotation of the body 112 that are both orthogonal to the first axis of rotation 115, by the fingers 105 or the thumb 104 of the hand 102 of the user, to a second orientation in which a second tactile feature different from the first tactile feature is selectively movable relative to its associated second face by the thumb or a finger of the hand of the user while the body is still supported in the second orientation by the other fingers or the palm of the same hand of the user (see FIG. 12).

Figure 15:
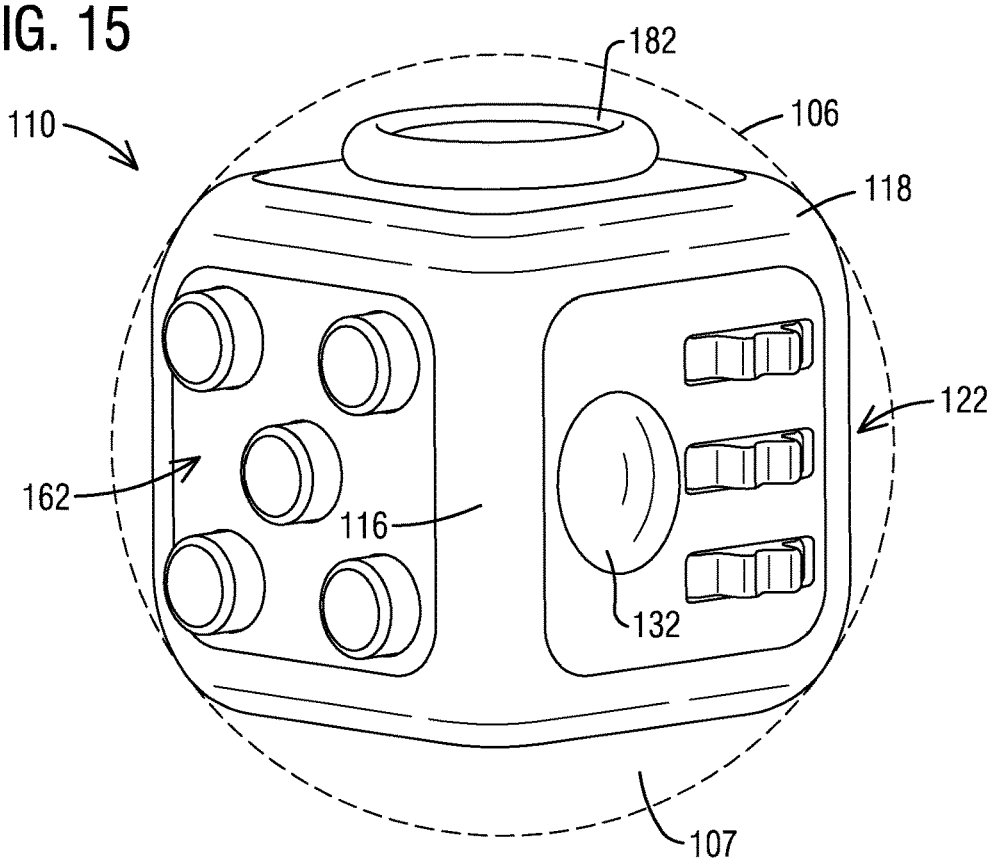
FIGS. 15 and 16 illustrate the degree of protrusion of the tactile features from their associated faces relative to an imaginary sphere defined by the rounded corners of the handheld touch apparatus.
Figure 16:
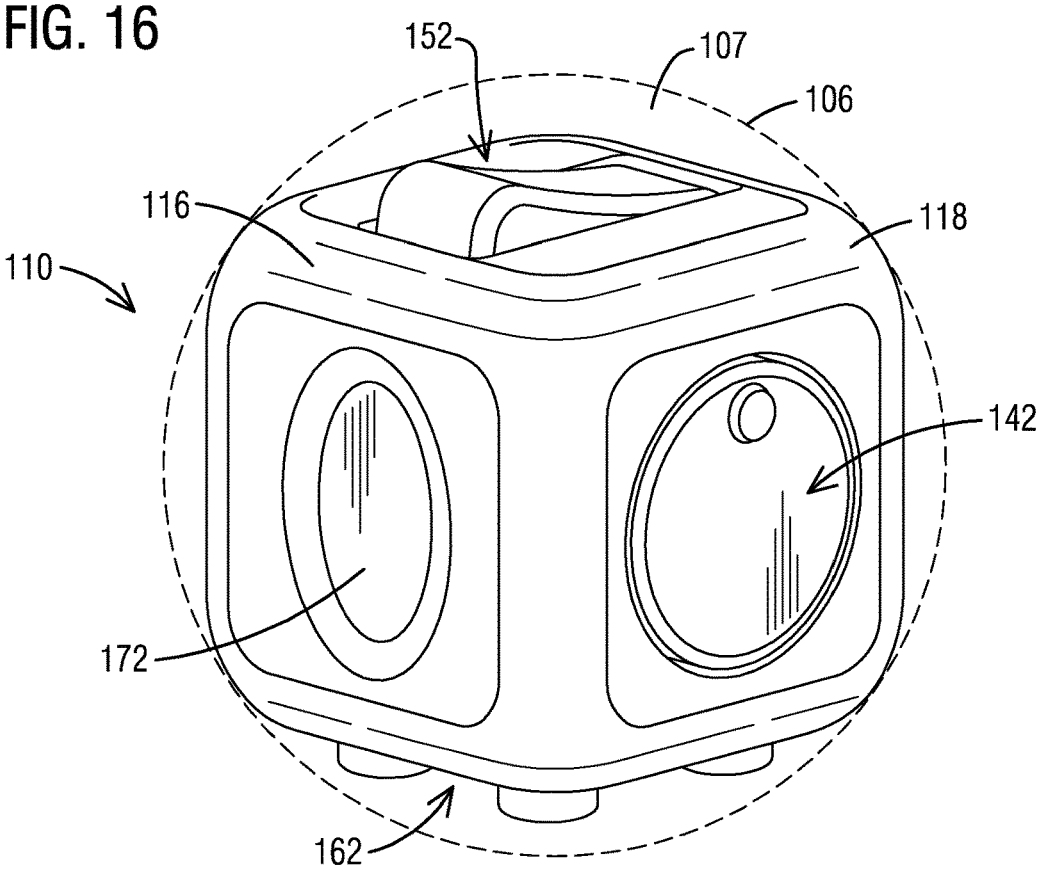

As shown in FIGS. 15 and 16, moreover, the degree or height to which the movable tactile features extend from the faces of the body 112 can be limited so that each of the tactile features 122, 132, 142, 152, 162, 172, and 182 is substantially contained within the volume 107 of an imaginary sphere 106 that is defined by the rounded corners 118 of the body 112. In other words, the tactile features can be considered "low profile" structures in that the tactile features themselves do not generally contact the supporting fingers of the hand during rotation or repositioning in a way that would block or hinder the intended movement. When combined with the symmetrical shape of the body 112, this feature can be particularly useful because it allows for the touch apparatus 110 to be easily rotated and repositioned, in any direction and about any axis, with just a single hand of a user having average or even below average dexterity, thus making all of the above-described benefits and advantages readily available to the common purchaser or user of the touch apparatus.

Furthermore, this feature can also allow the user to tightly grasp and squeeze the touch apparatus 110 in a moment of frustration or anger, as shown in FIG. 14, but without pressing the flesh of the hand into the tactile features to a degree that would cause pain or discomfort, since the primary contact surfaces between the touch apparatus 110 and the flesh of the hand in the closed, squeezing position are the radiused edges 116 and rounded corners 118 of the body 112. Consequently, the user is able to safely transfer or release this momentary excess stress energy into the body 112 of the touch apparatus 110 without harming himself. As described in more detail below, one way of achieving this low profile feature of the present disclosure is to ensure that at least 50% of a height of each independently-formed movable tactile feature is positioned below the outer surface 114 of its associated face.

In addition to the above, one or more of the movable tactile features may also comprise different colors or colored portions to provide a visual feedback as the tactile features are manipulated. For example the rotating risk 134 may have a spoke pattern disposed thereon, where the spokes are a different color to the rotating disk 134, and the colored spoked providing a visual feedback as the disk is rotated. In another example each dial 122 may include a color portion, e.g. a colored tooth or teeth that provide a visual feedback as the dials are manipulated by a user.

The handheld touch apparatus body 112 can be formed from one or more rigid materials. For instance, in one embodiment the material can be a rigid, lightweight plastics material such as a thermoplastic polyvinyl chloride (PVC) resin, otherwise known as vinyl. This can provide for the mass-production of the body component 112 through molding, vacuum forming, or any other suitable manufacturing method known to one of skill in the art. Alternatively, the body 112 of the handheld touch apparatus 110 can also be formed from a metal, such as a lightweight aluminum alloy, in which case the body 112 can be machined, cast, or forged to the appropriate dimensions.

The movable tactile features 122, 132, 142, 152, 162, and 182 can also be made from a plastic or a metal alloy material, whether the same material as the body 112 or a different material, and can be formed by any suitable process, including but not limited to molding, vacuum forming, machining, casting, forging, and the like. In one exemplary configuration using rigid plastic materials for both the tactile features and the body, the tactile features may be of a different color to the body 112. For example the movable tactile features 122, 132, 142, 152, 162, and 182 can formed of a plastics material that has a different color to the plastics material used to form the body 112. Alternatively, the body 112 and the tactile features are formed of the same colored material.

In addition to the movable tactile features that are generally formed separately from the body, the body of the touch apparatus may also be formed with a multi-part construction comprising multiple discrete parts and/or sub-assemblies, with each part or sub-assembly being coupled to the other parts or sub-assemblies to form the completed body of the apparatus that surrounds, contains, supports, and controls the tactile features extending outwardly from the faces thereof. For instance, in another embodiment of the handheld touch apparatus 210 illustrated in FIGS. 17-19, the body 212 may be formed with a two-part outer shell construction in which a first shell piece 291 and a second shell piece 292 can be connected together to form the outer shell of the body 212, and with an internal chassis member 296 then being retained within the outer shell. The chassis member 296 can further support one or more movable tactile feature sub-assemblies 225, 245, 255, 265, and 285 (FIG. 19) that can position and/or control the movement of the one or more movable tactile features that extend from the outer surfaces 214 of the body 212. It will be appreciated that any non-movable tactile features, such as the shallow recess 272 presented on one face of the touch object 210, can be formed directly into the outer surface of one of the shell pieces 291, 292.

As shown in the drawings, the two shell pieces 291, 292 can be formed of unequal two parts with a rabbet fit interface 293 (i.e. part line) that extends along or around multiple faces. The interface 293 can serve to align and connect the edges of the two shell pieces 291, 292 together to form a seam that is substantially flush with the outer surfaces 214 of the body 212 upon assembly. In one aspect the connection can be a snap fit connection, or alternatively, a more permanent connection may be achieved with an adhesive or by a suitable plastic welding process such as ultrasonic welding. In addition to the connection between the shell pieces 291, 292, the chassis 296 may also be secured to the shell pieces 291, 292 in a rigid manner during assembly of the touch apparatus 210, such as with a compression fit or slight interference fit along the inner surfaces of the rounded edges and corners.

Furthermore, with embodiments in which each of the shell pieces 291, 292 and the internal chassis member 296 are formed of a rigid plastics material, as discussed above, the body 212 of the touch apparatus 210 will not visually deform when squeezed or manipulated by a user's hands or fingers, and will substantially maintain its shape in response to any manual force being applied to the body 212.

The internal chassis member 296 can provide for the mounting of the movable tactile feature sub-assemblies 225, 245, 255, 265, and 285 that, in turn, can position and/or control the movement of the movable tactile features 222, 242, 252, 262, and 282, respectively. The internal chassis member 296 can also provide for the direct mounting and retention of one or more tactile features, such as the rollerball 232, that do not require an additional positioning and controlling sub-assembly. For instance, the rollerball 232 can be directly received with a spherical recess 235 that is formed into one of the faces of the chassis member 296.

Figure 17:
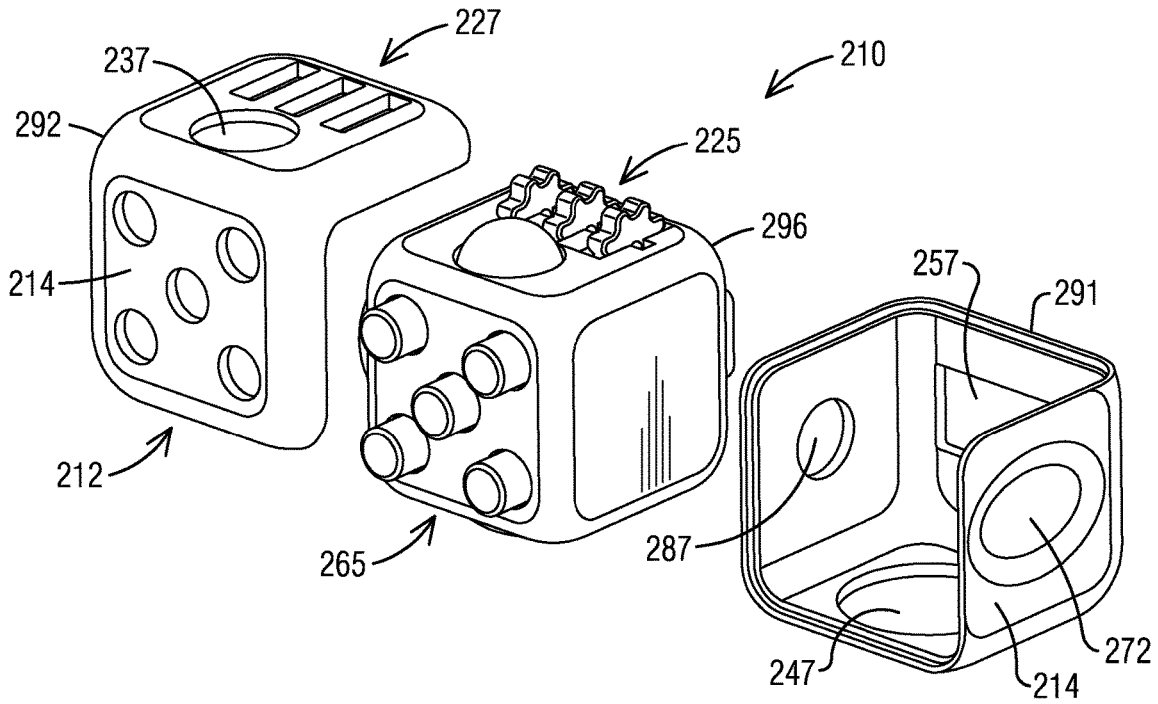
FIG. 17 is a perspective view of the handheld touch apparatus with its outer shell portions in an exploded state, in accordance with another representative embodiment of the present disclosure.
Figure 18:
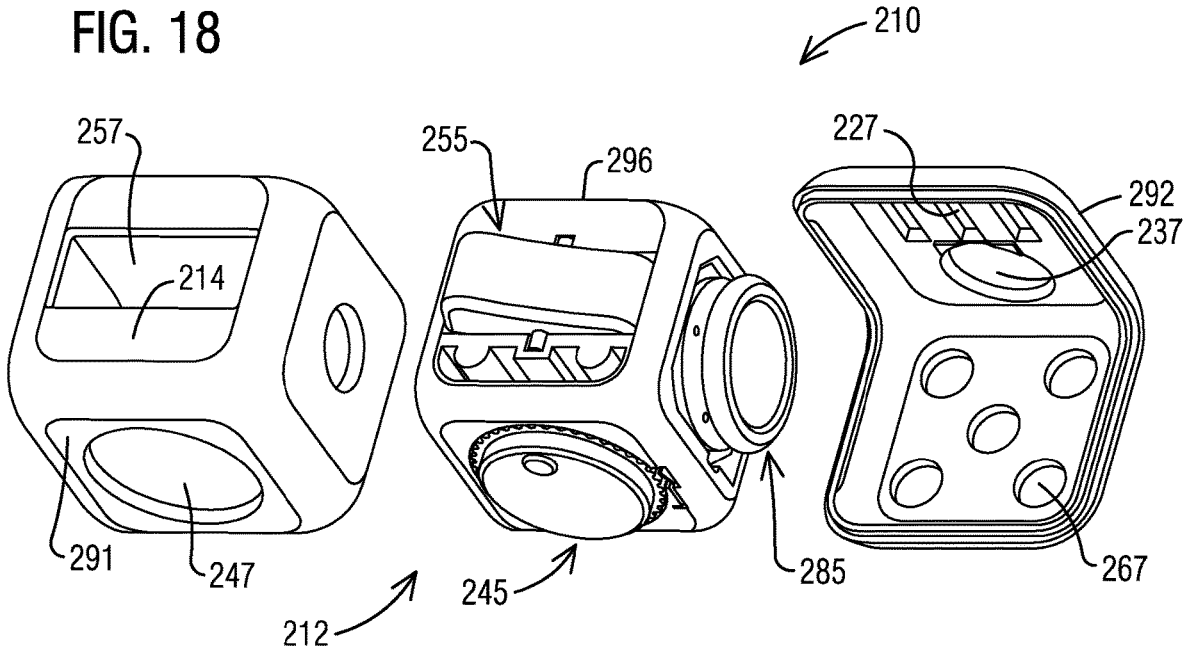
FIG. 18 is another perspective view of the handheld touch apparatus of FIG. 17.
Figure 19:
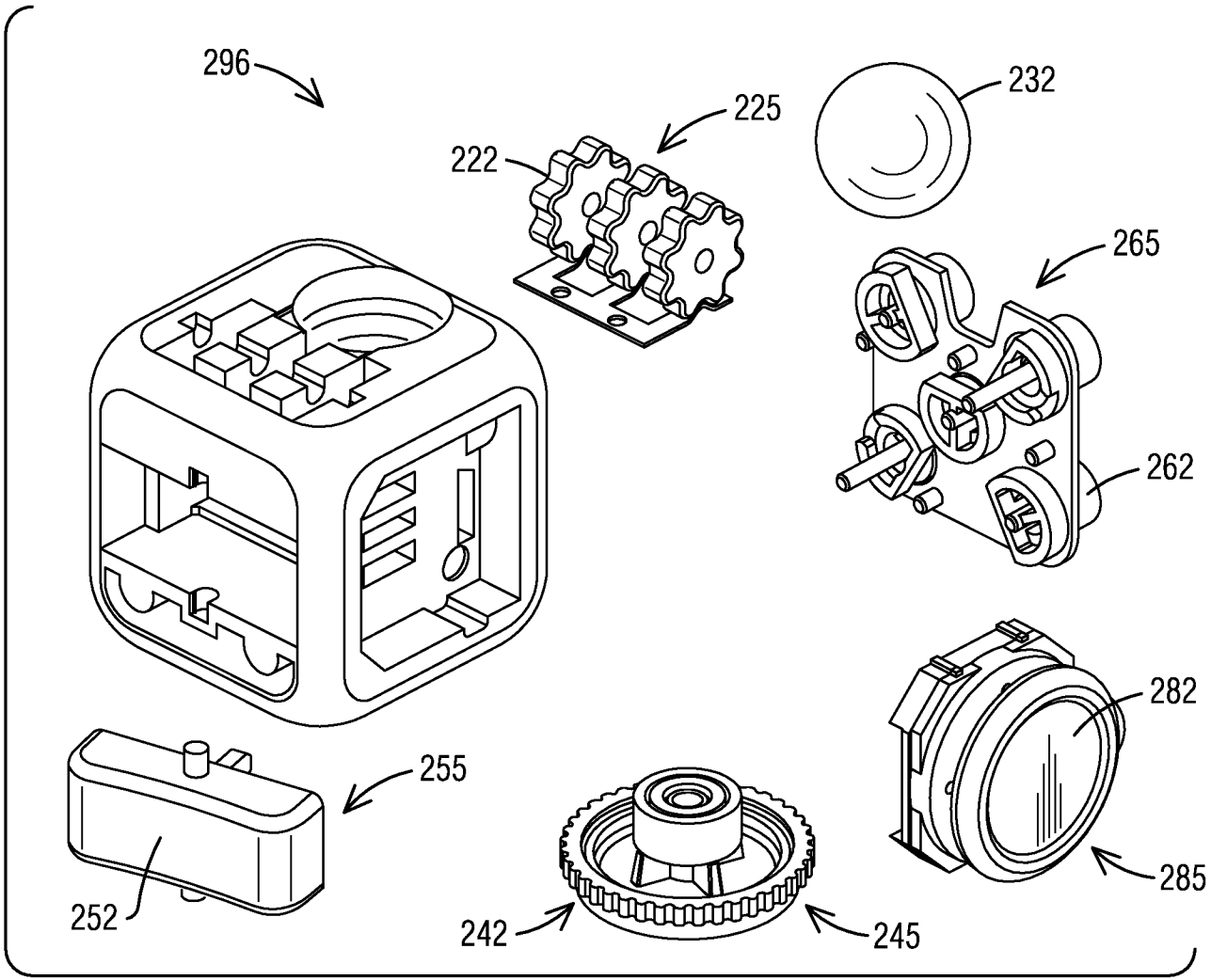
FIG. 19 is a perspective view of the handheld touch apparatus of FIG. 17 with the tactile elements in an exploded state.

With continuing reference to FIGS. 17-18, the shell pieces 291, 292 can generally include a plurality of appropriately sized and shaped openings for the tactile features held or retained by the chassis member 296 to project through. For example, one opening 237 can large enough for the outer portion of the rollerball 232 to project through, while still being smaller than the diameter of the rollerball 232 to help retain the rollerball in its seated condition within the spherical recess 235. In addition, a round opening or aperture 247 can preferably have a diameter that is just bigger than the diameter of the turning disk 242 so that the turning disk can sit within the opening 247 with a tight clearance around its perimeter edge. Rounded apertures 267, 287 can be provided for the push buttons 262 and for the axle 284 of the joystick 282, respectively, while non-round apertures 227, 257 can be provided for the dials 222 or gears 224 and for the toggle switch 252.

As with each of the previous embodiments disclosed hereinabove, the tactile features of the touch apparatus 210 can be low-profile in height and substantially contained within the volume of an imaginary sphere that is defined by the rounded corners 218 of the body 212. Each of the tactile features of the touch apparatus 210 can also be isolated from the tactile features on the adjacent faces by the radiused edges 216 of the body 212, and not directly accessible from any another face of the body. As shown in the exploded view of FIG. 19, for example, this can be accomplished by locating the movable tactile feature sub-assemblies 225, 245, 255, 265, and 285 within the internal chassis member 296 so that at least 50% of a height of each independently-formed movable tactile feature 222, 242, 252, 262, and 282 can be positioned below the outer surface 214 of its associated face upon assembly of the shell pieces 291, 292 with the internal chassis member 296.

Figure 20:
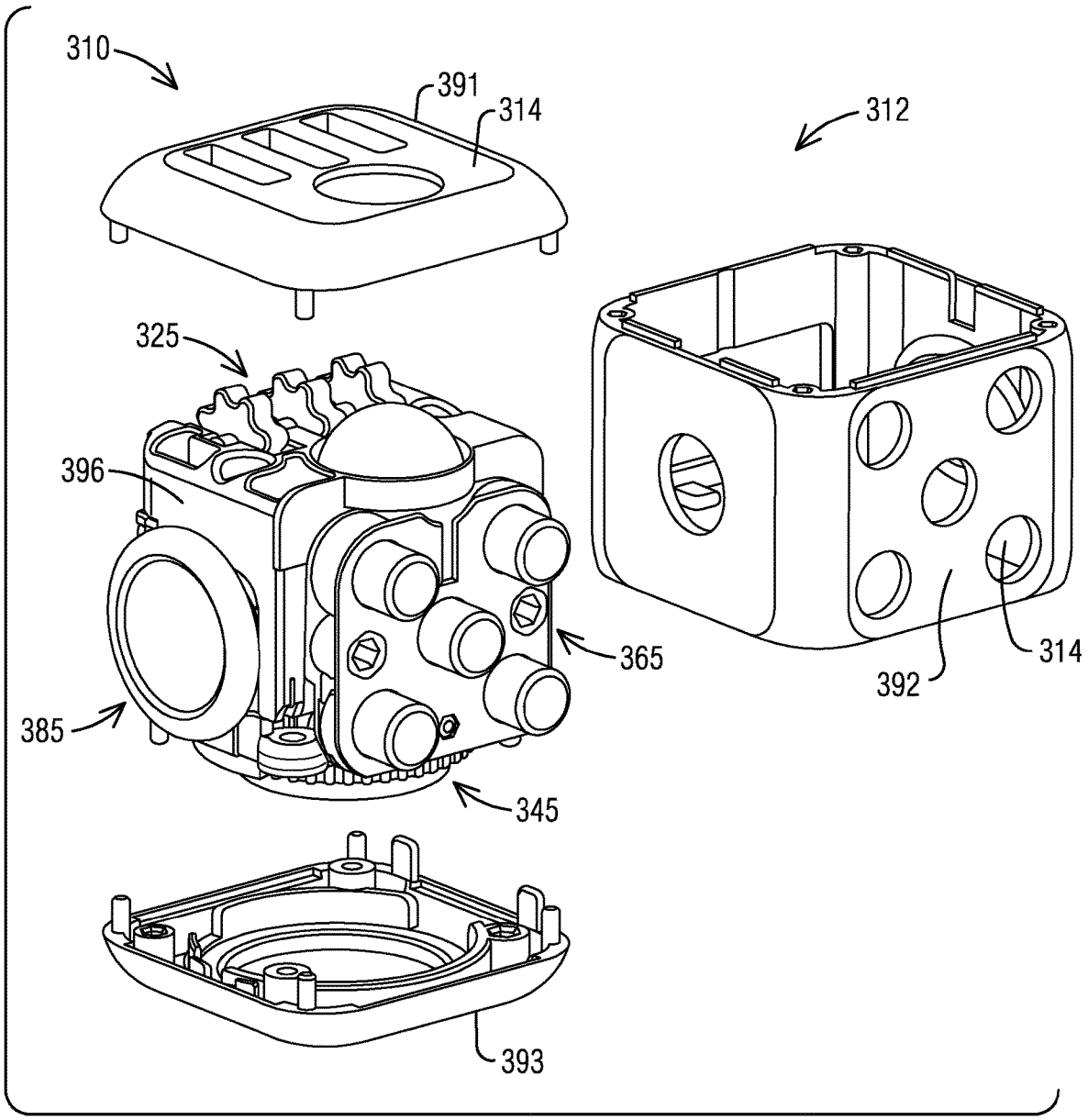
FIG. 20 is a perspective view of the handheld touch apparatus with its outer shell portions in an exploded state, in accordance with yet another representative embodiment of the present disclosure.

FIG. 20 illustrates yet another embodiment of touch apparatus 310 of the present disclosure having a body 312 with a three-piece outer shell construction, in which two end cap pieces 391, 393 can be coupled to a squared tubular center piece 392. In addition, the internal chassis member 396 of touch apparatus 310 can be subdivided into separate chassis pieces (not shown) that can also support the tactile feature sub-assemblies 325, 345, 355, 365, and 385 that position and control the movement of the movable tactile features that extend through the openings or apertures in the outer shell 390 to protrude above the outer surfaces 314 of the body 312.

As indicated above, the invention has been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments of the composite substrate without departing from the spirit and scope of the invention. These and other revisions might be made by those of skill in the art without departing from the spirit and scope of the invention that is constrained only by the following claims.

What is claimed is:

1. A touch apparatus for providing a variety of tactile sensations to the fingers, thumb, and palm of a hand of a user, the touch apparatus comprising:

a multi-faceted block body having an outer surface defined by a plurality of planar faces joined together by radiused edges that meet together to form rounded corners, the block body sized for holding within the palm of the hand of the user and for being rotated and manipulated by the fingers and thumb of the same hand; and a plurality of tactile features, with at least one tactile feature extending from or being formed into each of the plurality of planar faces, with each of the tactile features being contained within a volume of an imaginary sphere defined by the rounded corners of the block body, and with each tactile feature being isolated from a tactile feature on an adjacent planar face by a radiused edge of the block body, wherein a first tactile feature is selectively movable relative to its associated first planar face by the thumb or a finger of the hand of the user while the block body is supported in a first orientation by the other fingers or the palm of the same hand of the user, with a first axis of rotation of the block body projecting out of the plane of the associated first planar face, and wherein the block body is rotatable in at least one angular direction by the fingers or the thumb of the hand of the user to a second orientation in which a second tactile feature different from the first tactile feature is selectively movable relative to its associated second planar face by the thumb or a finger of the hand of the user while the block body is supported in the second orientation by the other fingers or the palm of the same hand of the user.

2. The touch apparatus of claim 1, wherein the block body is rectangular.

3. The touch apparatus of claim 1, wherein the block body is cubic.

4. The touch apparatus of claim 1, wherein each of the plurality of tactile features is different and distinct from the other tactile features.

5. The touch apparatus of claim 1, wherein at least 50% of a height of each tactile feature is positioned below the outer surface of its associated planar face.

6. The touch apparatus of claim 1, wherein each of the plurality of tactile features extends from or is formed into a single planar face.

7. The touch apparatus of claim 1, wherein the block body is formed from a material selected from the group consisting of a rigid plastic and a metal.

8. The touch apparatus of claim 1, wherein each of the plurality of tactile features is formed from a material selected from the group consisting of a rigid plastic and a metal.

9. The touch apparatus of claim 1, wherein a movement of at least one of the plurality of tactile features is limited to rotation about an axis that is perpendicular to the plane of its associated planar face.

10. The touch apparatus of claim 9, wherein the at least one tactile feature is a turning disk.

11. The touch apparatus of claim 1, wherein a movement of at least one of the plurality of tactile features is limited to rotation about an axis that is parallel to the plane of its associated planar face.

12. The touch apparatus of claim 11, wherein the at least one tactile feature is selected from the group consisting of a dial and a toggle switch.

13. The touch apparatus of claim 1, wherein a movement of at least one of the plurality of tactile features is limited to translation along axis that is perpendicular to the plane of its associated planar face.

14. The touch apparatus of claim 13, wherein the at least one tactile feature is a depressible button.

15. The touch apparatus of claim 1, wherein a movement of at least one of the plurality of tactile features includes translation in any direction that is parallel to the plane of its associated planar face.

16. The touch apparatus of claim 15, wherein the at least one tactile feature is a joystick.

17. The touch apparatus of claim 1, wherein at least one of the plurality of tactile features is a non-movable surface feature formed into the material of its associated planar face.

18. The touch apparatus of claim 17, wherein the at least one of the plurality of tactile features is a shallow recess having an oval shape.

19. A touch apparatus for providing a variety of tactile sensations to the fingers, thumb, and palm of a hand of a user, the touch apparatus comprising:

a multi-faceted block body having an outer surface defined by a plurality of planar faces joined together by radiused edges that meet together to form rounded corners, the block body sized for holding within the palm of the hand of the user and for being rotated and manipulated by the fingers and thumb of the same hand; and a plurality of tactile features, with at least one tactile feature extending from or being formed into each of the plurality of planar faces, with each of the tactile features being contained within a volume of an imaginary sphere defined by the rounded corners of the block body, wherein the plurality of tactile features further includes at least three movable tactile features extending from three planar faces of the block body.

20. The touch apparatus of claim 19, further comprising a non-movable tactile feature formed into a fourth planar face of the block body.

21. The touch apparatus of claim 19, wherein the block body is rectangular.

22. The touch apparatus of claim 19, wherein the block body is cubic.

23. The touch apparatus of claim 19, wherein a movement of at least one of the movable tactile features is limited to rotation about an axis that is perpendicular to the plane of its associated planar face.

24. The touch apparatus of claim 19, wherein a movement of at least one of the movable tactile features is limited to rotation about an axis that is parallel to the plane of its associated planar face.

25. The touch apparatus of claim 19, wherein a movement of at least one of the movable tactile features is limited to translation along an axis that is perpendicular to the plane of its associated planar face.

26. The touch apparatus of claim 19, wherein a movement of at least one of the movable tactile features includes translation in any direction that is parallel to the plane of its associated planar face.

* * * * *